US012187403B1

(12) United States Patent
Konrad

(10) Patent No.: US 12,187,403 B1
(45) Date of Patent: Jan. 7, 2025

(54) STERN DRIVE PROPELLER HUB ASSEMBLY

(71) Applicant: Ken Konrad, Hudson, WI (US)

(72) Inventor: Ken Konrad, Hudson, WI (US)

( * ) Notice: Subject to any disclaimer, the term of this patent is extended or adjusted under 35 U.S.C. 154(b) by 551 days.

(21) Appl. No.: 17/525,059

(22) Filed: Nov. 12, 2021

Related U.S. Application Data

(60) Provisional application No. 63/113,372, filed on Nov. 13, 2020.

(51) Int. Cl.
*B63H 5/10* (2006.01)
*B63H 23/32* (2006.01)

(52) U.S. Cl.
CPC ..... *B63H 5/10* (2013.01); *B63H 2005/106* (2013.01); *B63H 2023/323* (2013.01)

(58) Field of Classification Search
CPC ..... B63H 23/321; B63H 2023/323; B63H 2023/325; B63H 2023/327; B63H 23/34; B63H 2023/342; B63H 23/36
USPC ..... 440/49, 78, 79, 80, 81, 83
See application file for complete search history.

(56) References Cited

U.S. PATENT DOCUMENTS

| | | | | |
|---|---|---|---|---|
| 4,925,369 | A | 5/1990 | Steiner | |
| 4,993,151 | A | 2/1991 | Steiner | |
| 5,424,663 | A | 6/1995 | Meisenberg | |
| 5,759,074 | A | 6/1998 | Jones | |
| 7,153,101 | B2 * | 12/2006 | Mansson | B63H 23/34 416/129 |
| 7,223,076 | B2 | 5/2007 | Mansson | |
| 10,239,600 | B2 | 3/2019 | Diekevers | |

* cited by examiner

*Primary Examiner* — Daniel V Venne
(74) *Attorney, Agent, or Firm* — Eggink & Eggink; Anthony G. Eggink; Katrina M. Eggink

(57) ABSTRACT

A tapered counter rotating propeller hub assembly for a stern drive marine propulsion assembly. The propeller hub assembly having aligned forward and aft tapered hubs with a predetermined slope.

20 Claims, 3 Drawing Sheets

STERN DRIVE PROPELLER HUB ASSEMBLY

The present application claims the benefit of U.S. Patent Application Ser. No. 63/113,372, filed on Nov. 13, 2020, and which is incorporated by reference herein.

BACKGROUND OF THE INVENTION

The present invention relates generally to a propeller hub assembly for marine stem drive propulsion assemblies. The invention relates particularly to a counter rotating propeller marine propulsion assembly having a propeller hub assembly with tapered and aligned propeller hubs.

A stern drive is a marine propulsion assembly wherein an inboard power system is utilized with an outboard drive. The power system, such as an engine, is typically mounted forward of the transom of the vessel while the drive unit extends outside the hull. The counter or contra rotating propellers are arranged one behind the other and power from the engine is transferred via a geared transmission. The counter rotating propeller assembly provides maximum speed and a counter acting torque for the marine vessel.

Prior art stem drives typically direct engine exhaust through the drive cases and through the propeller hub to reduce the vacuum produced by the hub going through the water. However, the resultant exhaust back pressure is detrimental to engine performance particularly to turbocharged diesel engines. The hub assembly of the present invention is designed to overcome this problem.

Prior art counter rotating propeller propulsion assemblies, as shown in FIG. 1, typically utilize two cylindrical propeller hub structures which essentially doubles the length of the propeller hub assembly. The latter assembly length increase causes stem lift and is detrimental to the ultimate speed of planing boats. The tapered counter rotating propeller hub assembly of the present invention overcomes the problems and limitations of the prior art by reducing the area and outer diameter of the propeller hub assembly and thus the resultant amount of stem lift.

SUMMARY OF THE INVENTION

The propeller hub assembly of the invention is for a stern drive marine propulsion assembly. Stern drive propulsion systems utilize an inboard engine communicating with an outboard drive unit supported by the vessel transom. The drive unit includes a lower gear case from which the propeller hubs extend. The stem drive tapered propeller hub assembly of the invention has inner and outer propeller shafts with a hub housing, a forward propeller, an aft propeller, and hub securement structures. The hub housing or propeller case is adapted to envelop the inner and outer propeller shafts. The forward propeller is mounted to the hub housing and has a tapered outer hub surface with propeller blades extending therefrom. The tapered hub of the forward propeller has an axial splined opening or splined cylindrical bore for engaging the mating splined outer propeller shaft. A hub securement structure is provided to secure the forward propeller to the outer propeller shaft. An aft propeller is mounted adjacent and aligned with the forward propeller and has a tapered outer hub surface with propeller blades extending therefrom. The tapered hub of the aft propeller has an axial splined opening or splined cylindrical bore for engaging the mating splined inner propeller shaft. The aft propeller hub axial opening has a terminal end. A hub securement structure is mounted within the terminal end of the axial opening of the tapered hub of the aft propeller and is adapted to secure the aft propeller hub to the inner propeller shaft.

The aligned forward and aft propellers have tapered hub exteriors with a predetermined slope which may range from 4 to 10 degrees from horizontal and may have a preferred range of 6-7 degrees. The hub assembly may also be provided with ventilating air throughput extending from the hub housing to the terminal end of the aft propeller hub. Alternatively, a parabolic plug may be mounted at the terminal end of the aft propeller hub.

The counter rotating propeller hub assembly for stern drive propulsion of the invention utilizes tapered and aligned forward and aft propeller hubs which provide decreased stern lift and increased speed to the marine vessel.

The propeller hub assembly may also be provided with the use of ventilating air or an end plug to reduce the vacuum which results as the hubs travel through the water.

These and other benefits of this invention will become clear from the following description by reference to the drawings.

DESCRIPTION OF THE PREFERRED EMBODIMENTS

Figure 1:
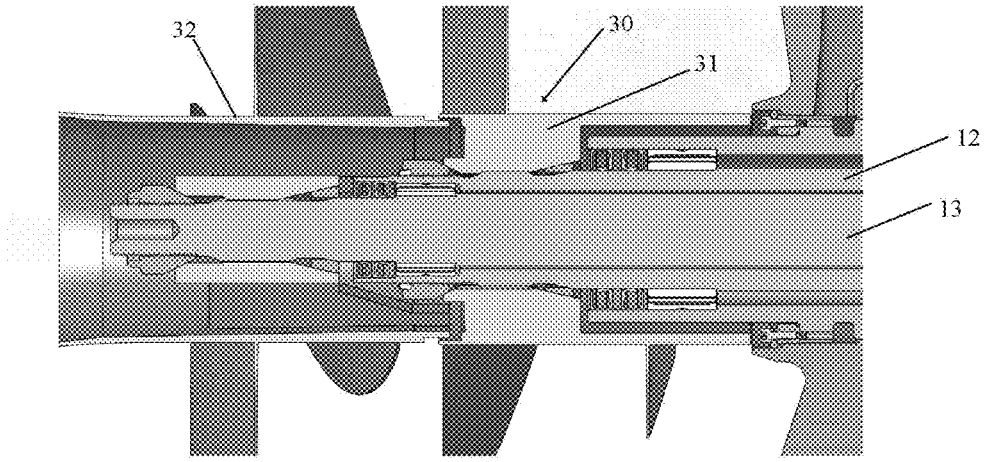
PRIOR ART FIGURE 1
FIG. 1 is a sectional view showing a prior art propeller hub assembly.

The present invention relates to a counter-rotating propeller marine stem drive propulsion assembly utilizing tapered propeller hubs. FIG. 1 shows a prior art counter rotating propeller stem drive propeller hub assembly 30 having inner and outer propeller hubs 31 and 32, each having axial bores and mounted on cylindrical outer and inner propeller shafts extending outward from the propeller case. The inner and outer hubs 31 and 32 have generally cylindrical outer surface configurations, the latter resulting in an elongated hub assembly producing stem lift and reducing relative efficiency and speed of the marine vessel.

Figure 2:
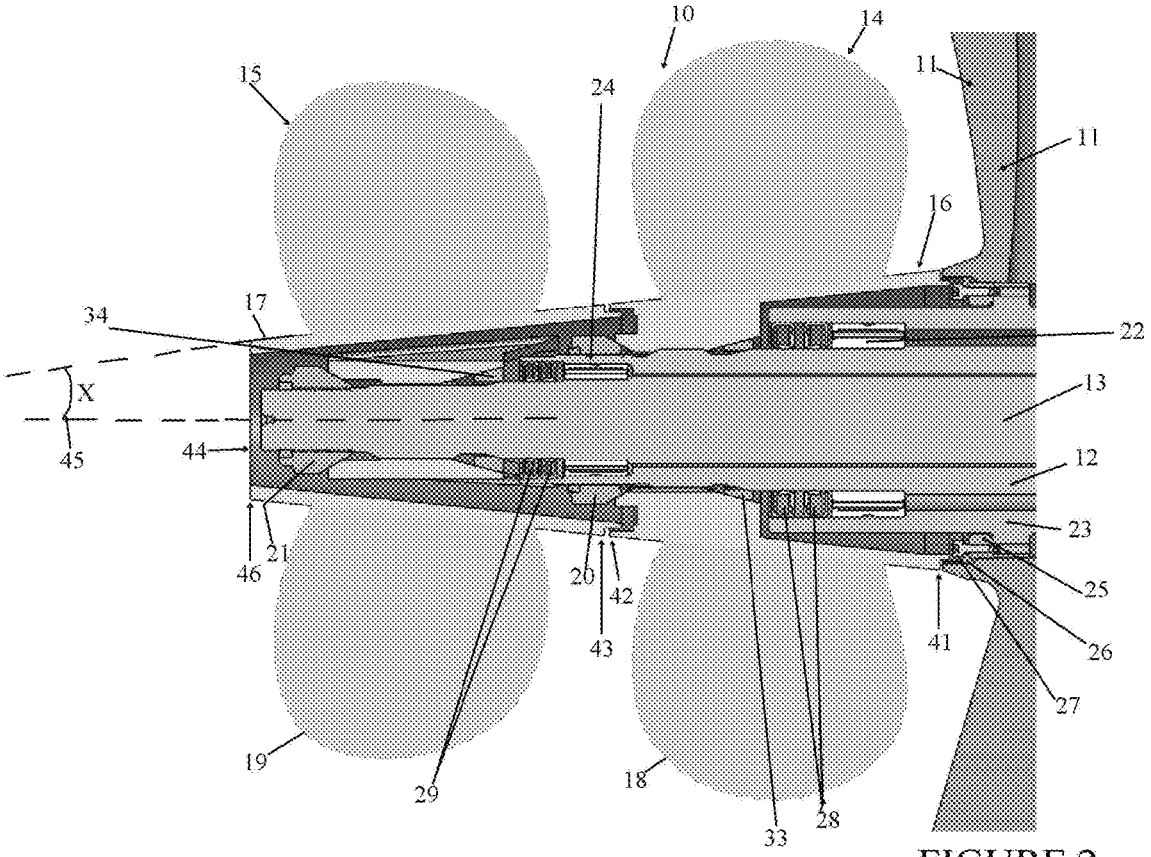
FIG. 2 is a sectional view showing a propeller housing having tapered forward and aft propeller hubs of the present invention.

In FIGS. 1 and 2 the respective stem drive counter rotating propeller assemblies 30 and 10 are shown mounted to concentric, generally cylindrical propeller shafts 12 and 13 which are shown to extend outward from the propeller case and bearing carrier which are further shown extending outward.

Referring to FIG. 2, the tapered propeller hub assembly 10 for a counter rotating propeller stem drive propulsion assembly of the present invention is shown. The tapered hub configuration 10 of the invention is for a counter rotating propeller structure whereby the length/area of the tapered exterior hub surfaces and the amount of ventilating air through the hub assembly are both reduced to thereby reduce stern lift during operation of a marine vessel.

The propeller hub assembly 10 is shown extending outward by means of bearing carrier 23, propeller case 11, retaining nut 25 and tab washer 26 and retaining screws 27.

Figure 5:
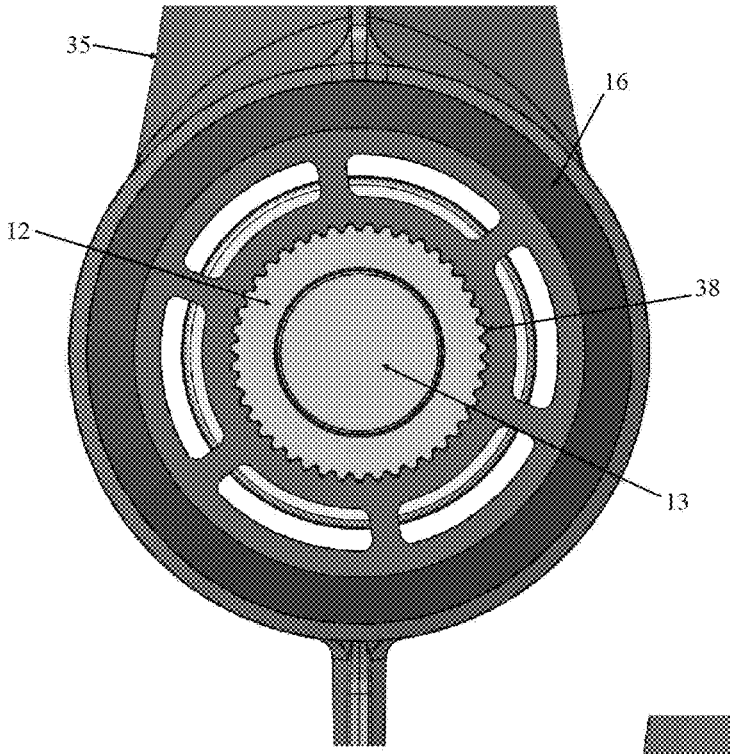
FIG. 5 is a cross sectional view of the lower unit of a stem drive assembly showing the splined engagement between the outer propeller shaft and the forward tapered propeller hub.
Figure 6:
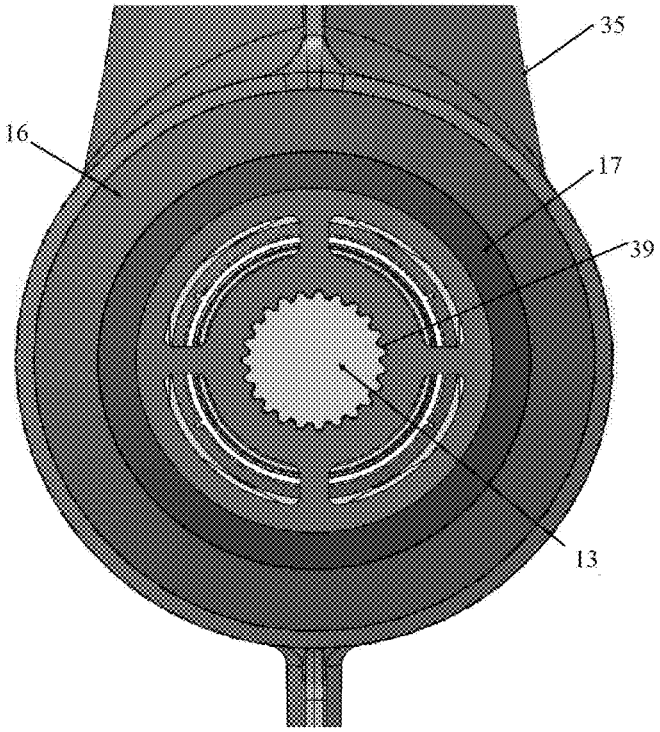
FIG. 6 is a cross sectional view of the lower unit of a stem drive assembly showing the splined engagement between the inner propeller shaft and the aft tapered propeller hub.

The propeller hub assembly 103 is shown having an inner and outer propeller shaft 13, 12 with a propeller case 11, a forward propeller structure 14, an aft propeller structure 15, and first and second hub securement structures 20 and 21. The tapered hubs are constructed and arranged to envelop the inner and outer propeller shafts 13, 12 which are generally cylindrical in configuration. The forward propeller structure 14 is shown having a tapered hub 16 with propeller blades 18 extending therefrom. A first securement structure or propeller nut 20 secures the forward propeller 14 to propeller shaft 12. The tapered hub 16 of the forward propeller structure 14 has a splined axial opening or splined cylindrical bore to matingly engage the splined outer propeller shaft 12 as further discussed below. The splined shafts and mating splined tapered hubs may be provided with a plurality of splines, as shown in FIGS. 5 and 6.

Figure 4:
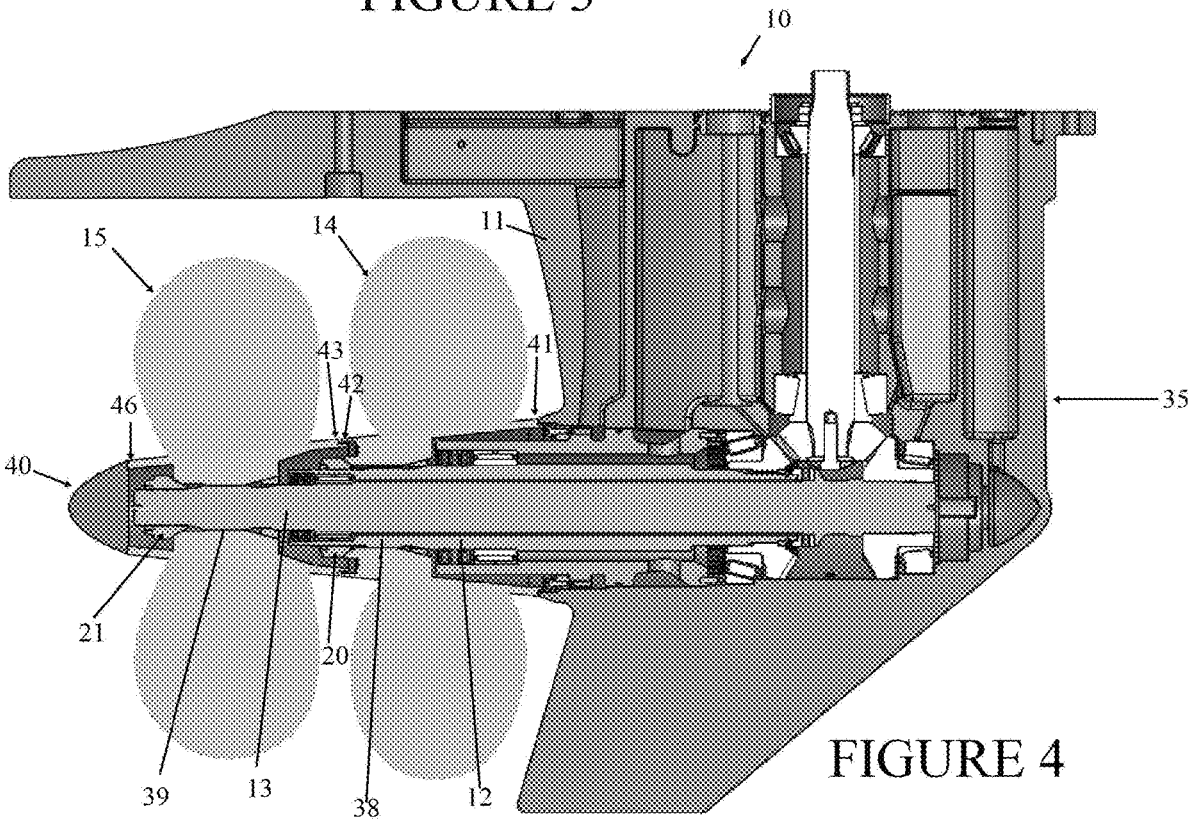
FIG. 4 is a cross sectional view of the lower unit of a stem drive assembly showing a parabolic shaped cap mounted to the terminal end of the aft propeller hub.

The aft propeller 15 is shown mounted adjacent and aligned with the forward propeller 14 and has a tapered hub 17 with propeller blades 19 extending from the tapered hub exterior surface. The tapered hub 17 of the aft propeller 15 has a splined axial opening or splined cylindrical bore for matingly engaging the inner propeller shaft 13. The all propeller hub 17 axial opening has a terminal end opening 44. A second securement structure or aft propeller nut 21 is shown mounted within the terminal end of the axial opening of the tapered hub 17 of the aft propeller 15 and is adapted to secure the aft propeller hub 17 to the inner propeller shaft 13. The propeller nut 21 is shown positioned within the terminal end and adjacent the tapered hub end opening 44. The terminal end opening 44 may be provided with a cap or plug 40 (FIG. 4) which would eliminate the ventilating air requirement. The cap 40, as shown in FIG. 4, may have a parabolic configuration.

As shown, the forward propeller shaft 12 and aft propeller shaft 13 are each disposed within the tapered hub structures 16 and 17 and which are shown to have an aligned slope of angle X. The tapered hub 16 is shown secured to propeller shaft 12 by means of a securement assembly having a propeller nut 20, mounting sleeve 33, bearing 22 and seals 28. The aft propeller hub 17 is shown secured to the propeller shaft 13 by means of a securement assembly having aft mounting sleeve 34, propeller nut 21, seals 29 and bearing 24.

As further shown in FIG. 2, the tapered hub assembly 10 has a forward propeller 14 with an outside hub diameter 41 (D1) which tapers to outside diameter 42 (D2). The aft propeller 15 is shown aligned with the forward propeller 14 and has an outside hub diameter 43 (D3) which tapers to outside diameter 46 (D4). A small gap is shown between D2 and D3 to provide a gap between the hubs of the counter-rotating propellers 14 and 15, however, as shown the slope of the hubs are aligned. The sloped exterior surfaces of the tapered hubs 16 and 17 are shown having an angle X which may range from approximately 4 to 10 degrees from a horizontal axis 45. A slope of approximately six to seven degree slope is preferred.

Figure 3:
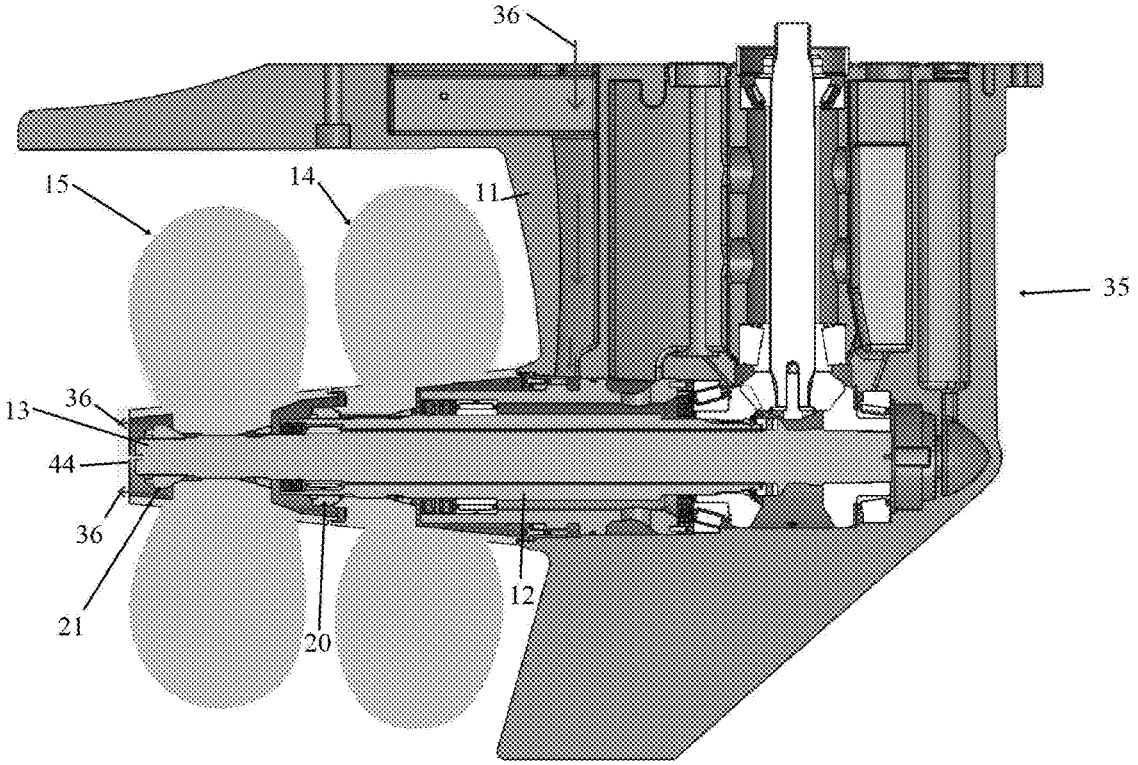
FIG. 3 is a cross-sectional view of the lower unit of a stem drive assembly showing the movement of ventilating air through the hub assembly.

FIG. 3 is a sectional view of the lower unit or gear case 35 of the stern drive assembly showing the movement of ventilating air 36 through the propeller assembly hub assembly. A small amount of air flow from the upper unit of the stem drive structure is shown exiting from the terminal end opening 44 of the aft propeller 15. Alternatively, as shown in FIG. 4 an end plug 40 may be provided for mounting in the terminal end opening of the aft propeller 15. The end cap 40 is shown to have a generally parabolic shape. The ventilating airflow 36 shown in FIG. 3 or the end cap 40 shown in FIG. 4 provide for decreased stern lift and thus increased speed for a marine vessel utilizing the tapered and aligned forward and aft propeller hubs.

FIGS. 5 and 6 are sectional views of the lower gear case 35 of the stern drive assembly at the forward propeller hub 16 and aft propeller hub 17, respectively, and showing the splined engagement 38 between the outer propeller shaft 12 and the forward tapered propeller hub 16 and the splined engagement 39 between the inner propeller shaft 13 and the aft tapered propeller hub 17, respectively. The splined engagement of the inner and outer shafts with the propeller hubs 16 and 17 are also shown in FIG. 4.

As many changes are possible to the stern drive counter rotating tapered propeller hub assembly embodiments of this invention utilizing the teachings thereof, the descriptions above, and the accompanying drawings should be interpreted in the illustrative and not in the limited sense.

That which is claimed is:

1. A propeller hub assembly for a counter rotating propeller stern drive propulsion assembly having an inner and outer propeller shaft, said propeller hub assembly comprising:

a) a hub housing having an opening adapted to envelop the inner and outer propeller shafts;

b) a forward propeller mounted to said hub housing and having a tapered hub exterior with propeller blades extending therefrom, said tapered hub of said forward propeller having an axial opening having a first diameter for engaging the outer propeller shaft;

c) a first securement structure adapted to secure said forward propeller to the outer propeller shaft;

d) an aft propeller mounted adjacent and aligned with said forward propeller, said all propeller having a tapered hub exterior with propeller blades extending therefrom, said tapered hub of said aft propeller having an axial opening having a second diameter for engaging the inner propeller shaft, said axial opening having a terminal end; and e) a second securement structure mounted within said terminal end of said axial opening of said tapered hub of said aft propeller and being adapted to secure said aft propeller hub to the inner propeller shaft.

2. The propeller hub assembly of claim 1, wherein said tapered hub exterior of said forward and aft propellers have a predetermined slope.

3. The propeller hub assembly of claim 2, wherein said predetermined slope ranges between 4-10 degrees from horizontal.

4. The propeller hub assembly of claim 3, wherein said predetermined slope is approximately 6 or 7 degrees from horizontal.

5. The propeller hub assembly of claim 1, wherein said axial openings of said tapered hubs are cylindrical bores for engaging generally cylindrical propeller shafts.

6. The propeller hub assembly of claim 5, wherein said axial openings are splined to matingly engage cylindrical forward and aft splined propeller shafts.

7. The propeller hub assembly of claim 1, wherein ventilating air paths are provided from said hub housing through said forward and aft propeller hubs.

8. The propeller hub assembly of claim 1, wherein a parabolic plug is mounted at said terminal end of said aft propeller.

9. The propeller hub assembly of claim 1, wherein said forward and aft propellers have mounting sleeves.

10. A propeller hub assembly for a counter rotating propeller stern drive propulsion assembly having an inner and outer propeller shaft, said propeller hub assembly comprising:

a) a hub housing having an opening adapted to envelop the inner and outer propeller shafts;

b) a forward propeller mounted to said hub housing and having a tapered hub exterior with propeller blades extending therefrom, said tapered hub of said forward propeller having an axial opening having a first diameter for engaging the outer propeller shaft;

c) a first securement structure adapted to secure said forward propeller to the outer propeller shaft;

d) an aft propeller mounted adjacent and aligned with said forward propeller, said at propeller having a tapered hub exterior with propeller blades extending therefrom, said tapered hub of said aft propeller having an axial opening having a second diameter for engaging the inner propeller shaft, said axial opening having a terminal end, said tapered hub exteriors of said forward and aft propellers having a predetermined slope ranging between 4-10 degrees from horizontal; and e) a second securement structure mounted within said terminal end of said axial opening of said tapered hub of said aft propeller and being adapted to secure said aft propeller hub to the inner propeller shaft.

11. The propeller hub assembly of claim 10, wherein said predetermined slope is approximately 6 or 7 degrees from horizontal.

12. The propeller hub assembly of claim 10, wherein said axial openings of said forward and aft propeller hubs are cylindrical bores for engaging generally cylindrical propeller shafts.

13. The propeller hub assembly of claim 12, wherein said axial openings of said forward and aft propeller hubs are splined to matingly engage the generally cylindrical splined propeller shafts.

14. The propeller hub assembly of claim 10, wherein ventilating air paths are provided from said hub housing through said forward and aft propeller hubs.

15. The propeller hub assembly of claim 10, wherein a parabolic plug is mounted at said terminal end of said aft propeller hub.

16. A propeller hub assembly for a counter rotating propeller stern drive propulsion assembly having an inner and outer propeller shaft, said propeller hub assembly comprising:

a) a hub housing having an opening adapted to envelop the inner and outer propeller shafts;

b) a forward propeller mounted to said hub housing and having a tapered hub exterior with propeller blades extending therefrom, said tapered hub of said forward propeller having an axial opening having a first diameter for engaging the outer propeller shaft;

c) a first securement structure adapted to secure said forward propeller to the outer propeller shaft;

d) an aft propeller mounted adjacent and aligned with said forward propeller, said aft propeller having a tapered hub exterior with propeller blades extending therefrom, said tapered hub of said aft propeller having an axial opening having a second diameter for engaging the inner propeller shaft, said axial opening having a terminal end;

e) a second securement structure mounted within said terminal end of said axial opening of said tapered hub of said at propeller and being adapted to secure said aft propeller hub to the inner propeller shaft;

f) said axial openings of said tapered forward and aft hubs being splined cylindrical bores for engaging generally cylindrical splined propeller shafts; and g) said tapered hub exteriors of said forward and aft propellers having a predetermined slope ranging between approximately 4-10 degrees from horizontal.

17. The propeller hub assembly of claim 16, wherein said predetermined slope ranges between 6 and 7 degrees from horizontal.

18. The propeller hub assembly of claim 16, wherein ventilating air paths are provided from said hub housing through said forward and aft propeller hubs.

19. The propeller hub assembly of claim 16, wherein a parabolic plug is mounted at said terminal end of said aft propeller.

20. The propeller hub assembly of claim 16, wherein said forward and aft propellers have mounting sleeves.

* * * * *